US005388642A

United States Patent [19]

Puri et al.

[11] Patent Number: 5,388,642

[45] Date of Patent: Feb. 14, 1995

[54] COALBED METHANE RECOVERY USING MEMBRANE SEPARATION OF OXYGEN FROM AIR

[75] Inventors: Rajen Puri, Aurora, Colo.; Dan Yee, Tulsa, Okla.

[73] Assignee: Amoco Corporation, Chicago, Ill.

[21] Appl. No.: 147,111

[22] Filed: Nov. 3, 1993

[51] Int. Cl.[6] ..... E21B 43/18; E21B 43/26; E21B 43/40

[52] U.S. Cl. ..... 166/266; 166/268; 166/271

[58] Field of Search ..... 166/266, 267, 268, 271, 166/305.1; 95/47, 54

[56] References Cited

U.S. PATENT DOCUMENTS

| | | | |
|---|---|---|---|
| 4,043,395 | 8/1977 | Every et al. | 166/263 |
| 4,264,338 | 4/1981 | Null | 95/47 |
| 4,400,034 | 8/1983 | Chew | 299/5 |
| 4,446,921 | 5/1984 | Coenen et al. | 166/267 |
| 4,544,037 | 10/1985 | Terry | 166/369 |
| 4,756,367 | 7/1988 | Puri et al. | 166/263 |
| 4,883,122 | 11/1989 | Puri et al. | 166/263 |
| 5,014,785 | 5/1991 | Puri et al. | 166/263 |
| 5,014,788 | 5/1991 | Puri et al. | 166/308 |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |

FOREIGN PATENT DOCUMENTS

| | | | |
|---|---|---|---|
| 211523 | 2/1987 | European Pat. Off. | 95/47 |
| 609917 | 6/1978 | U.S.S.R. . | |

OTHER PUBLICATIONS

M. G. Zabetikis, et al., "Methane Control in United States Coal Mines-1972", U. S. Bureau of Mines, Information Circular 8600, pp. 8-16, (1973).

R. S. Metcalfe, D. Yee, J. P. Seidle, and R. Puri, "Review of Research Efforts in Coalbed Methane Recovery", SPE 23025, (1991).

M. D. Stevenson, W. V. Pinczewski and R. A. Downey, "Economic Evaluation of Nitrogen Injection for Coalseam Gas Recovery", SPE 26199, (1993).

N. Ali, P. K. Singh, C. P. Peng, G. S. Shiralkar, Z. Moschovidis and W. L. Baack, "Injection Above-Parting-Pressure Waterflood Pilot, Valhall Field, Norway", SPE 22893, (1991).

R. Puri and D. Yee, "Enhanced Coalbed Methane Recovery", SPE 20732, (1990).

Brian Evison and R. E. Gilchrist, "New Developments in Nitrogen in the Oil Industry", SPE 24313, (1992).

Alan A. Reznik, Pramod K. Singh and William L. Foley, "An Analysis of the Effect of Carbon Dioxide Injection on the Recovery of In-Situ Methane from Bituminous Coal: An Experimental Simulation", SPE/DOE 10822, (1982).

Ralph W. Veatch, Jr., Zissis A. Mosachovidis and C. Robert Fast, "An Overview of Hydraulic Fracturing", *Recent Advances in Hydraulic Fracturing*, vol. 12, chapter 1, pp. 1-38, S.P.E. Monograph Series, (1989).

N. R. Warpinski and Michael Berry Smith, "Rock Mechanics and Fracture Geometry", *Recent Advances in Hydraulic Fracturing*, vol. 12, chapter 3, pp. 57-80, S.P.E. Monograph Series, (1989).

(List continued on next page.)

*Primary Examiner*—George A. Suchfield
*Attorney, Agent, or Firm*—Charles P. Wakefield; Richard A. Kretchmer; Scott P. McDonald

[57] ABSTRACT

A method of recovering methane from a solid carbonaceous subterranean formation having a production well in fluid communication with the formation and an injection well in fluid communication with the formation, comprising the steps of passing a gaseous fluid containing at least 60 volume percent nitrogen and at least 15 volume percent oxygen through a membrane separator to produce an oxygen-depleted effluent, pressurizing the oxygen-depleted effluent to a pressure above a reservoir pressure of the solid carbonaceous subterranean formation, injecting the oxygen-depleted effluent into the formation through the injection well, and recovering a fluid comprising methane through the production well.

25 Claims, 1 Drawing Sheet

OTHER PUBLICATIONS

Nov. 9, 1990, Report of the Oil and Gas Conservation Commission of the State of Colorado.

"Kirk-Othmer Encyclopedia of Chemical Technology", 3rd Ed., vol. 15, pp. 92-131, (1981).

Jacob E. Koresh and Abrah Soffer, "The Carbon Molecular Sieve Membranes, General Properties and the Permeability of $CH_4/H_2$ Mixture", *Separation Science and Technology*, vol. 22, nos. 2&3, pp. 973-983, (1987).

Jacob E. Koresh and Abraham Sofer, "Molecular Sieve Carbon Permselective Membrane. Part 1. Presentation of a New Device for Gas Mixture Separation", *Separation Science and Technology*, vol. 18, No. 8, pp. 723-724, (1983).

Nigel McMullen and Miro Hojsaki, "Reconsider Noncryogenic Systems for On-Site Nitrogen Generation", *Chemical Engineering Progress*, pp. 58-61, (1993).

"Quaterly Review of Methane from CoalSeams Technology", *Gas Research Institute*, vol. 11, No. 1, p. 38, (1993).

Carl L. Schuster, "Detection Within the Wellbore of Seismic Signals Created by Hydraulic Fracturing", SPE 7448, (1978).

Amoco Production Company, Handout distributed at the International Coalbed Methane Symposium held in Birmingham, Ala., May 17-21, 1993.

Application for Enhanced Recovery Nitrogen Injection Pilot and Approval of Aquifer Exemption, submitted to the Colorado Oil and Gas Conservation Commission, Aug. 30, 1990.

Durango Herald Newspaper Article, "Planners OK Amoco Facilities", dated May 15, 1991.

La Plata County Planning Commission, Colorado Planning Commission Information Session of Mar. 1991 dealing with Amoco's Planned Nitrogen Injection Pilot.

United States Environmental Protection Agency Region VIII, Transmittal Letter of Feb. 11, 1992 approving Nitrogen Injection Pilot and Associated Permits.

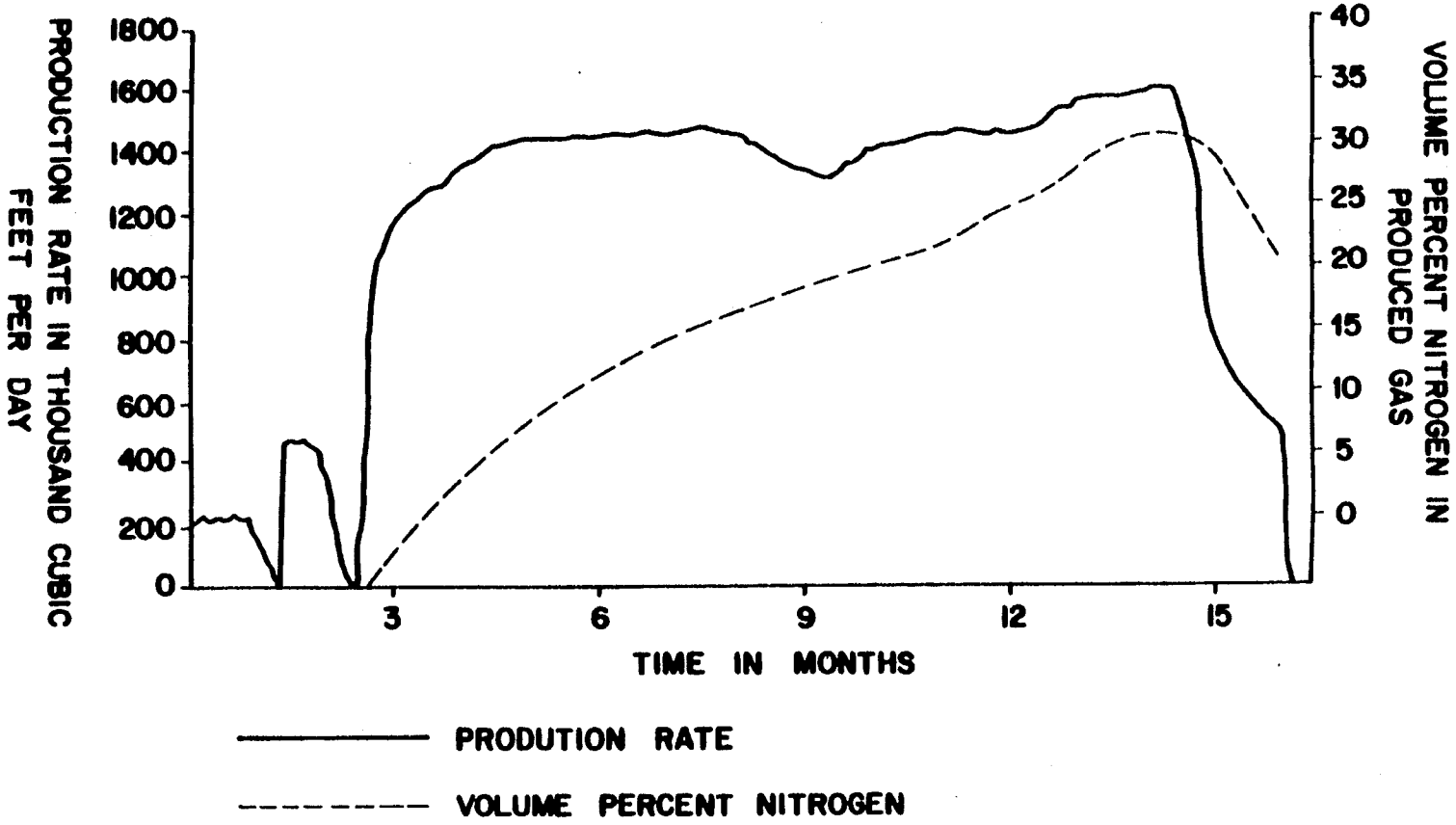
VOLUME PERCENT NITROGEN IN PRODUCED GAS
40
35
30
25
20
15
10
5
0
3
6
9
12
15
TIME IN MONTHS
1800
1600
1400
1200
1000
800
600
400
200
0
PRODUCTION RATE IN THOUSAND CUBIC FEET PER DAY
PRODUTION RATE
VOLUME PERCENT NITROGEN

COALBED METHANE RECOVERY USING MEMBRANE SEPARATION OF OXYGEN FROM AIR

FIELD OF THE INVENTION

The present invention is directed to a method for recovering methane from a solid carbonaceous subterranean formation, such as a coalbed, and in particular to a method for inputting a gaseous fluid containing at least 60 volume percent nitrogen and at least 15 volume percent oxygen into a membrane separator, withdrawing oxygen-depleted effluent from the separator, pressurizing the oxygen-depleted effluent to a pressure above the reservoir pressure of the solid carbonaceous subterranean formation, injecting the oxygen-depleted effluent into the solid carbonaceous subterranean formation and recovering a fluid comprising methane from the solid carbonaceous subterranean formation.

BACKGROUND OF THE INVENTION

It is believed that methane is produced during the conversion of peat to coal. The conversion is believed to be a result of naturally occurring thermal and biogenic processes. Because of the mutual attraction between the carbonaceous matrix of coal and the methane molecules, a large amount of methane can remain trapped in-situ as gas adhered to the carbonaceous products formed by the thermal and biogenic processes. In addition to methane, lesser amounts of other compounds such as water, nitrogen, carbon dioxide, and heavier hydrocarbons, and sometimes small amounts of other fluids such as argon and oxygen, can be found within the carbonaceous matrix of the formation. The gaseous fluids which are produced from coal formations collectively are often referred to as "coalbed methane." Coalbed methane typically comprises more than about 90 to 95 volume percent methane. The reserves of such coalbed methane in the United States and around the world are huge. Most of these reserves are found in coal beds, but significant reserves may be found in gas shales and other solid carbonaceous subterranean formations which are also believed to have resulted from the action of thermal and biogenic processes on decaying organic matter.

Methane is the primary component of natural gas, a widely used fuel source. Coalbed methane is now produced from coal seams for use as a fuel. Typically, a wellbore is drilled which penetrates one or more coal seams. The wellbore is utilized to recover coalbed methane from the seam or seams. The pressure difference between a coal seam and the wellbore provides the driving force for flowing coalbed methane to and out of the wellbore. Reduction of pressure in the coal seam as coalbed methane is produced increases desorption of methane from the carbonaceous matrix of the formation, but, at the same time, deprives the system of the driving force necessary to flow coalbed methane to the wellbore. Consequently, this method loses its effectiveness over time for producing recoverable coalbed methane reserves. It is generally believed that this method is only capable of economically producing about 35 to 70% of the methane contained in a coal seam.

An improved method for producing coalbed methane is disclosed in U.S. Pat. No. 5,014,785 to Puri, et al. In this process, a methane-desorbing gas such as an inert gas is injected into a solid carbonaceous subterranean formation through at least one injection well, with a methane-containing gas recovered from at least one production well. The desorbing gas, preferably nitrogen, mitigates depletion of pressure within the formation and is believed to desorb methane from the carbonaceous matrix of the formation by decreasing the methane partial pressure within the formation. This method is effective for increasing both the total amount and rate of methane production from a solid carbonaceous subterranean formation such as a coal seam. Present indications are that the rate of methane production can be increased and that the total amount of methane recovered can be increased substantially, to possibly 80% or more of the methane contained in the formation.

Puri, et al., U.S. Pat. No. 5,014,785, further discloses that air is a suitable source of nitrogen for increasing methane production. However, injecting an oxygen-containing gas, such as air, into a solid carbonaceous subterranean formation, such as a coal seam, to increase production of methane can present problems. Oxygen can cause corrosion and rust formation in well casings and other fluid conduits. Also, injected oxygen-containing gases are potentially flammable. It is desirable to provide an economically attractive method to minimize these potential problems by depleting the oxygen content of air before injecting the oxygen-depleted air into a solid carbonaceous subterranean formation, such as a coal seam, for increasing methane production.

U.S. Pat. No. 5,133,406 to Puri, et al., discloses depleting the oxygen content of air before injecting air into a coal seam by putting air and a source of fuel, such as methane, into a fuel cell power system, generating electricity, and forming a fuel cell exhaust comprising oxygen-depleted air. While this system is advantageous for producing oxygen-depleted air at remote locations, particularly where there is need for generating electricity for on-site needs, there is a need for less expensive methods of producing oxygen-depleted air suitable for use in the production of coalbed methane, particularly where there is not a need for additional on-site electricity.

As used herein, the following terms shall have the following meanings:

(a) "air" refers to any gaseous mixture containing at least 15 volume percent oxygen and at least 60 volume percent nitrogen. "Air" is preferably the atmospheric mixture of gases found at the well site and contains between about 20 and 22 volume percent oxygen and between about 78 and 80 volume percent nitrogen.

(b) "cleats" or "cleat system" is the natural system of fractures within a solid carbonaceous subterranean formation.

(c) a "coalbed" comprises one or more coal seams in fluid communication with each other.

(d) "formation parting pressure" and "parting pressure" mean the pressure needed to open a formation and propagate an induced fracture through the formation.

(e) "fracture half-length" is the distance, measured along the fracture, from the wellbore to the fracture tip.

(f) "recovering" means a controlled collection and/or disposition of a gas, such as storing the gas in a tank or distributing the gas through a pipeline. "Recovering" specifically excludes venting the gas into the atmosphere.

(g) "reservoir pressure" means the pressure of a productive formation near a well during shut-in of that well. The reservoir pressure of the formation may change over time as oxygen-depleted effluent is injected into the formation.

(h) "solid carbonaceous subterranean formation" refers to any substantially solid, methane-containing material located below the surface of the earth. It is believed that these methane-containing materials are produced by the thermal and biogenic degradation of organic matter. Solid carbonaceous subterranean formations include but are not limited to coalbeds and other carbonaceous formations such as shales.

(i) "well spacing" or "spacing" is the straight-line distance between the individual wellbores of a production well and an injection well. The distance is measured from where the wellbores intercept the formation of interest.

SUMMARY OF THE INVENTION

The general object of this invention is to provide a method for recovering methane from solid carbonaceous subterranean formations. A more specific object of this invention is to provide a method for generating oxygen-depleted effluent for use in recovering methane from a solid carbonaceous subterranean formation. Other objects of the present invention will appear hereinafter.

One embodiment of the invention is a method for recovering methane from a solid carbonaceous subterranean formation having a production well in fluid communication with the formation and an injection well in fluid communication with the formation, the method comprising the steps of:

(a) passing a gaseous fluid containing at least 60 volume percent nitrogen and at least 15 volume percent oxygen through a membrane separator to produce an oxygen-depleted effluent;

(b) injecting the oxygen-depleted effluent into the formation through the injection well;

(c) recovering a fluid comprising methane through the production well; and (d) operating the production well so that a pressure in the production well at a wellbore location adjacent to the formation is less than an initial reservoir pressure of the formation.

In a second embodiment of the invention, a method is disclosed for recovering methane from a coalbed having a production well in fluid communication with the coalbed and an injection well in fluid communication with the coalbed, comprising the steps of:

(a) passing a gaseous fluid containing at least 60 volume percent nitrogen and at least 15 volume percent oxygen through a membrane separator to produce an oxygen-depleted effluent having less than 95% by volume nitrogen;

(b) injecting the oxygen-depleted effluent into the coalbed through the injection well; and (c) recovering a fluid comprising methane through the production well.

In a third embodiment of the invention, a method is disclosed for at least doubling the rate of recovery of methane from a production well penetrating a coalbed and producing A standard cubic feet of methane per day, which comprises the steps of:

(a) passing air containing about 15 to 25% by volume oxygen through a membrane separator to produce an oxygen-depleted effluent comprising a volume ratio of nitrogen to oxygen of at least 9:1; and (b) injecting the oxygen-depleted effluent into the coalbed through an injection well at a pressure lower than a parting pressure of the coalbed at a rate sufficient to increase the production of methane from the production well to at least 2A standard cubic feet of methane per day.

In a fourth embodiment of the invention, a method is disclosed for increasing the production of methane from a coalbed penetrated by an injection well and a production well, which comprises the steps of:

(a) recovering methane from a production well at A standard cubic feet per day;

(b) passing air containing about 15 to 25% by volume oxygen through a membrane separator to produce an oxygen-depleted effluent comprising a volume ratio of nitrogen to oxygen of at least 9:1; and (c) injecting the oxygen-depleted effluent through the injection well at a rate sufficient to increase the recovery of methane from the production well to at least 2A standard cubic feet per day within 90 days of the first injection of oxygen-depleted effluent.

The invention provides an oxygen-depleted effluent with most of the advantages of pure nitrogen, but which is less expensive to produce than pure nitrogen. Additionally, with the invention, nitrogen does not have to be transported to the methane production site nor does an expensive cryogenic air separation plant have to be provided on-site for separating nitrogen from air. The membrane separators utilized in the invention can be portable and are easily transferred to another portion of a field under production or to another coalbed methane field. Injecting oxygen-depleted effluent into the solid carbonaceous subterranean formation reduces the potential for rust formation and corrosion in piping, production equipment, and wellbore casing, and using oxygen-depleted effluent reduces the potential of fire or explosion in the injection equipment. Further, membrane separators useful in this invention are less expensive than fuel cell power systems.

Numerous other advantages and features of the present invention will become readily apparent from the following detailed description of the invention, the embodiments described therein, the claims, and the accompanying drawing.

BRIEF DESCRIPTION OF THE DRAWING

The FIGURE is a graph of the rate of total fluids recovered over time from a field which utilized oxygen-depleted air to enhance the recovery of methane from a coalbed. The total fluids recovered primarily contain methane and nitrogen, with a small volume percentage of water. The graph also shows the volume percent of nitrogen over time in the total fluids recovered.

DETAILED DESCRIPTION OF THE PREFERRED EMBODIMENTS

While this invention is susceptible of embodiment in many different forms, there are shown in the drawing, and will be described in detail herein, specific embodiments of the invention. It should be understood, however, that the present disclosure is to be considered as an exemplification of the principles of the invention and is not intended to limit the invention to the specific embodiments illustrated.

Any membrane separator capable of separating oxygen from nitrogen can be used in this invention. A general discussion on membrane systems, which includes the transport mechanisms within membranes, physical structure of membranes, and membrane system configurations, is contained in "Kirk-Othmer Encyclopedia of Chemical Technology" 3rd Ed., Volume 15, pages 92–131 (1981), which is incorporated herein by reference. Examples of membrane separators which can be utilized are membrane separators sold by "NIJECT" Services Co., hereinafter referred to as NIJECT, located in Tulsa, Okla. and Generon Systems, hereinafter referred to as "GENERON", located in Houston, Tex.

Membrane separator systems useful in this invention typically include a compressor section and a membrane section. The compressor section compresses inlet gaseous fluid, which contains at least 60 volume percent nitrogen and at least 15 volume percent oxygen, to a suitable pressure. The preferred inlet gaseous fluid is air found at the production site. The pressurized gaseous fluid is then passed through the membrane section of the membrane separator system. The membrane sections of both the "GENERON" separator system and the "NIJECT" separator system are equipped with hollow fiber bundles which produce an oxygen-depleted effluent fraction and an oxygen-enriched effluent fraction.

The hollow fiber bundles should preferentially separate the nitrogen from the other components of the inlet gaseous fluid, such as oxygen. Several flow regimes which take advantage of the selective permeability of the hollow fiber bundles can be utilized. For example, the inlet gaseous fluid can be passed through the hollow fibers or it can be injected under pressure into the region surrounding the fibers. In the "NIJECT" separator, for example, compressed air on the outside of the hollow fibers provides the driving energy which causes oxygen, carbon dioxide and water to permeate into the interior of the hollow fibers, while oxygen-depleted effluent remains outside of the fibers. The oxygen-depleted effluent leaves the unit at about the inlet pressure of about 50 p.s.i.g. or higher, generally at least about 100 p.s.i.g.

In the "GENERON" separator, for example, compressed air is passed through the inside of the hollow fibers. A pressure differential between the inside and outside of the fiber provides the driving energy which causes the oxygen-enriched air to pass through the walls of the hollow fibers from the high pressure region to the lower pressure region. Oxygen-depleted effluent is maintained inside the hollow fibers and leaves the separator at an elevated pressure of about 50 p.s.i.g. or higher, preferably at least about 100 p.s.i.g. Although the subject invention is not to be so limited, it is believed that the costs associated with compression of the oxygen-depleted effluent, such as the cost of compression equipment and the cost of the energy used to drive the compression equipment, will typically be in excess of 50% of the total cost required to produce methane using the invention. Therefore, it is preferable to use a membrane separator system which, for a given oxygen-depleted effluent through-put, minimizes the pressure drop across the membrane separator. This will reduce the total cost of producing and compressing oxygen-depleted effluent for use in enhancing the production of methane from a solid carbonaceous subterranean formation.

The membrane separator can be operated at an inlet pressure of about 50 to about 250 p.s.i.g., preferably about 100 to about 200 p.s.i.g., and within the proper operating parameters to reduce the oxygen content of the oxygen-depleted effluent to the desired volume ratio of nitrogen to oxygen. In general, the concentration of oxygen in the oxygen-depleted effluent is dependent on the through-put of oxygen-depleted effluent through the membrane separator. For example, for a membrane system, the higher the inlet pressure to the membrane section of the membrane separator system, the higher the through-put, and the more oxygen in the oxygen-depleted effluent and the less oxygen in the oxygen-enriched effluent. The lower the inlet pressure to the membrane section of the membrane separator system, the lower the through-put, and the lower the oxygen content of the oxygen-depleted effluent. This relationship between inlet pressure and oxygen content of the effluent is for a system which is operating within the designed operating range of the membrane system with all major variables other than the inlet pressure to the membrane section of the membrane separator system being held constant and which utilizes a membrane which is more permeable to oxygen than nitrogen.

The flow rate of the oxygen-depleted effluent produced must be high enough to provide an adequate flow while still providing for adequate fractionation of the gaseous fluid into its components. Where flammability in the injection wellbore due to the presence of oxygen in the oxygen-depleted effluent is an important consideration, the membrane separator preferably should be operated to provide an oxygen-depleted effluent having a nitrogen-to-oxygen volume ratio of about 9:1 to about 99:1. It is more preferable to operate the membrane separator to provide an oxygen-depleted effluent having from about 2 to 8% by volume oxygen.

Where flammability in the injection wellbore due to the presence of oxygen in the oxygen-depleted effluent is not an important consideration, the membrane separator is preferably operated to provide a relatively high flow of oxygen-depleted effluent having up to 94.9 volume percent nitrogen. Although commercial membrane separators are typically configured to provide oxygen-depleted effluent having between 95 and 99.1 volume percent nitrogen, it is believed that reconfiguring a membrane separator system to provide an oxygen-depleted effluent having 94.9 or less volume percent nitrogen will greatly increase the quantity of oxygen-depleted effluent produced from the separator as compared to standard commercial separators. This will greatly reduce the processing costs for producing oxygen-depleted effluent using a membrane separator system.

For example, a typical membrane separator processing gaseous fluid having about 80 volume percent nitrogen and about 20 volume percent oxygen and which is producing an oxygen-depleted effluent having 99 or greater volume percent nitrogen provides about thirty-five moles of oxygen-depleted effluent for every one hundred moles of gaseous fluid processed by the separator. Decreasing the nitrogen volume percent in the oxygen-depleted effluent to from about 90% to 94.9% will provide from about seventy to about sixty moles of oxygen-depleted effluent for every one hundred moles of gaseous fluid processed by the separator. Therefore, the cost of producing oxygen-depleted effluent can be substantially reduced by decreasing the volume percent nitrogen in the oxygen-depleted effluent.

Injection of the Oxygen-Depleted Effluent

The oxygen-depleted effluent is injected into the solid carbonaceous subterranean formation at a pressure higher than the reservoir pressure. Preferably, the oxygen-depleted effluent is injected at a pressure of from about 500 p.s.i.g. to about 1500 p.s.i.g. above the reservoir pressure of the formation. If the injection pressure is below or equal to the reservoir pressure, the oxygen-depleted effluent typically cannot be injected because it cannot overcome the reservoir pressure of the formation. The oxygen-depleted effluent is injected preferably at a pressure below the formation parting pressure of the solid carbonaceous subterranean formation. If the injection pressure is too high and the formation extensively fractures, injected oxygen-depleted effluent may be lost and less methane may be produced.

However, based on studies of other types of reservoirs, it is believed that oxygen-depleted effluent may be injected into the formation at pressures above the formation parting pressure as long as induced fractures do not extend from an injection well to a production well. In fact, injection above formation parting pressure may be required in order to achieve sufficient injection and/or recovery rates to make the process economical or, in other cases, may be desired to achieve improved financial results when it can be done without sacrificing overall performance. Preferably, the fracture half-length of the induced fractures within the formation is less than from about 20% to about 30% of the spacing between an injection well and a production well. Also, preferably, the induced fractures should be maintained within the formation.

Parameters important to the recovery of methane, such as fracture half-length, fracture azimuth, and height growth can be determined using formation modeling techniques which are known in the art. Examples of the techniques are discussed in John L. Gidley, et al., Recent Advances in Hydraulic Fracturing, Volume 12, Society of Petroleum Engineers Monograph Series, 1989, pp. 25–29 and pp. 76–77; and Schuster, C. L., "Detection Within the Wellbore of Seismic Signals Created by Hydraulic Fracturing", paper SPE 7448 presented at the 1978 Society of Petroleum Engineers' Annual Technical Conference and Exhibition, Houston, Tex., October 1–3. Alternatively, the fracture half-length and impact of its orientation can be assessed using a combination of pressure transient analysis and reservoir flow modeling such as described in SPE 22893, "Injection Above-Fracture-Parting Pressure Pilot, Valhal Field, Norway," by N. Ali et al., 69th Annual Technical Conference and Exhibition of the Society of Petroleum Engineers, Dallas, Texas, October 6–9, 1991. While it should be noted that the above reference describes a method for enhancing oil recovery by injection of water above fracture-parting-pressure, it is believed that the methods and techniques discussed in SPE 22893 can be adapted to enhance the recovery of methane from a solid carbonaceous subterranean formation.

In general, the deeper the solid carbonaceous subterranean formation, the higher the pressure necessary to inject the oxygen-depleted effluent into the formation. Typically, an injection pressure of from about 400 to 2000 p.s.i.g. will be sufficient to inject oxygen-depleted effluent into a majority of the formations from which it is desirable to recover methane using the invention.

The oxygen-depleted effluent is injected into the solid carbonaceous subterranean formation through an injection well in fluid communication with the formation. Preferably, the injection well penetrates the methane-containing formation, but the injection well need not penetrate the formation as long as fluid communication exists between the formation and the injection well. The injection of oxygen-depleted effluent may be either continuous or discontinuous. The injection pressure may be maintained constant or varied.

A fluid comprising methane is recovered from a production well in fluid communication with the formation. As with the injection well, the production well preferably penetrates the methane-containing formation, but the production well need not penetrate the formation as long as fluid communication exists between the formation and the production well. The production well or wells are operated in accordance with conventional coalbed methane recovery wells. It may be desirable to minimize the backpressure on a production well during recovery of fluids comprising methane through that production well. The reduction of back-pressure on the production well will assist the movement of the fluid, comprising methane, from the formation to the wellbore.

Preferably, a production well is operated so that the pressure in the production well at a wellbore location adjacent the methane producing formation is less than the initial reservoir pressure of the formation. The wellbore location adjacent the methane producing formation is within the wellbore, not the formation. The initial reservoir pressure is the reservoir pressure near the production well of interest at a time before the initial injection of oxygen-depleted effluent into the formation. The reservoir pressure may increase during the injection of oxygen-depleted effluent, but it is believed that the pressure in the production well near the formation preferably should be maintained less than the initial reservoir pressure. This will enhance the movement of fluid from the formation to the wellbore. Most preferably, the pressure in a production well at a wellbore location adjacent the methane producing formation should be less than about 400 p.s.i.g.

In some instances back-pressure on a production well's wellbore may be preferable, for example, when it is desirable to maintain a higher reservoir pressure to minimize the influx of water into the formation from surrounding aquifers. Such an influx of water into the formation could reduce the methane recovery rate and also complicate the operation of a production well.

Another situation where it can be preferable to maintain back-pressure on a production well's wellbore is when there is concern over the precipitation and/or condensation of solids and/or liquids within the formation near the wellbore or in the wellbore itself. The precipitation and/or condensation of solids or liquids in or near the wellbore could reduce the methane recovery rate from a production well. Examples of materials which may precipitate or condense out near the wellbore and present a problem are occluded oils, such as waxy crudes. It is believed that a higher pressure in the production well's wellbore at a location adjacent to the formation will minimize such precipitation and/or condensation of solids or liquids in or near the wellbore. Therefore, if precipitation and condensation in the wellbore are a problem, it may be preferable to increase the pressure in the production well's wellbore to a value as high as practicable.

Preferably, a solid carbonaceous subterranean formation, as utilized in the invention, will have more than one injection well and more than one production well in fluid communication with the formation.

The timing and magnitude of the increase in the rate of methane recovery from a production well will depend on many factors including, for example, well spacing, thickness of the solid carbonaceous subterranean formation, cleat porosity, injection pressure and injection rate, injected gaseous fluid composition, sorbed gas composition, reservoir pressure, and cumulative production of methane prior to injection of oxygen-depleted effluent.

When the foregoing parameters are generally held constant, a smaller spacing between an injection well and a production well will result in a faster observable production well response (both an increase in the recovery rate of methane and a shorter time before injected oxygen-depleted effluent appears at a production well) than the response which occurs with an injection well and a production well separated by a larger spacing. When spacing the wells, the desirability of a fast increase in the rate of methane production must be balanced against other factors such as earlier nitrogen breakthrough when utilizing a reduced well spacing and the quantity of oxygen-depleted effluent utilized to desorb the methane from the formation for any given spacing.

If desired, the methane produced in accordance with this invention can be separated from co-produced gases, such as nitrogen or mixtures of nitrogen and any other gas or gases which may have been injected or produced from the solid carbonaceous subterranean formation. Such co-produced gases will, of course, include any gases that occur naturally in solid carbonaceous subterranean formations together with the methane. As discussed earlier, these naturally-occurring gases together with the methane are commonly referred to as coalbed methane. These naturally occurring gases can include, for example, hydrogen sulfide, carbon dioxide, ethane, propane, butane, and heavier hydrocarbons in lesser amounts. If desired, the methane produced in accordance with this invention can be blended with methane from other sources which contain relatively fewer impurities.

The produced methane can be blended with an oxygen-enriched air fraction, such as that co-produced in the physical separation of air into oxygen-rich and oxygen-depleted fractions. This procedure is the subject of co-filed application Ser. No. 08/147,121, which is hereby incorporated by reference. As noted therein, produced methane containing nitrogen or mixtures of nitrogen and other gases can be blended with the oxygen-enriched fraction produced from the production of an oxygen-depleted effluent. Alternatively, the produced methane containing mixture can be conveyed to the point of use for blending with the oxygen-enriched fraction to raise the heating value of the methane blend.

EXAMPLE

This Example shows that it is possible to more than double the rate and amount of methane produced while injecting oxygen-depleted air. A pilot test of this invention was carried out in a coalbed methane field containing two production wells. Each of the production wells had been producing on a pressure depletion basis (driven by the reservoir pressure) from a 20 foot thick coal seam located approximately 2,700 feet from the surface for about 4 years prior to this test. The average production from the production well which would be utilized as the production well during the pilot was 200,000 cubic feet of methane per day prior to commencing the pilot test. Both of the production wells were shut-in and one was converted to an injection well. Three additional injection wells were drilled down to the same 20-foot thick coal seam. The sole remaining production well was brought on-line by itself for a short period of time and then shut-in. Its production rate during the short period of time was higher than its previous average production rate of about 200,000 cubic feet of methane per day. It is believed that this transient rate was a result of the earlier shut-in of both production wells.

The five wells utilized in the pilot test can be visualized as a "5-spot" on a die or domino covering an 80-acre square area with the injection wells surrounding the production well (i.e. the injection wells were each about 1800 feet from each other). Inlet air was compressed to about 140 p.s.i.g. by two air compressors in parallel and passed through a skid-mounted small-10 foot by 10-foot by 20-foot "NIJECT" membrane separation unit equipped with hollow fiber bundles. The compressed air on the outside of the fibers provided the driving energy for causing oxygen, carbon dioxide and water vapor to permeate into the hollow fibers while oxygen-depleted air stream remains on the outside of the hollow fibers. About 1,200,000 cubic feet of oxygen-enriched air, which contained about 40% by volume oxygen, exited the unit per day. The oxygen-depleted air, which contained between about 4 and 5% oxygen leaving the membrane separation unit at about the input pressure, was compressed to approximately 1000 p.s.i.g. in a reciprocating electric injection compressor. Oxygen-depleted air was injected into the four injection wells at a rate of 300,000 cubic feet per day per well for several months. As can be seen from the FIGURE, within one week, the volume of gaseous fluid produced from the production well increased to between 1.2 to 1.5 million cubic feet per day. Initially the well produced very little nitrogen, but, over time, the nitrogen content increased to over 30% by volume of the total fluids recovered.

The results of the pilot test as shown in the FIGURE demonstrate that it is possible to at least double the rate of methane recovery from a solid carbonaceous subterranean formation, such as a coal seam, by injecting oxygen-depleted effluent into the formation. The doubled rate of methane recovery can be maintained for at least twelve months. It was further shown that a recovery rate four times the pre-injection recovery rate could be maintained for at least eleven months, and five times the pre-injection rate could be maintained for at least five months.

Based on the pilot test it is believed that the methane recovery rate can be increased to twice the pre-injection recovery rate within ninety days of commencing injection of oxygen-depleted effluent, preferably within thirty days of commencing injection of oxygen-depleted effluent. It is further believed that the methane recovery rate can be increased to five times its pre-injection value within two months of commencing injection.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made and materials may be substituted for those disclosed described in the application. For example, a membrane separator system which utilizes hollow fibers which are more permeable to nitrogen than oxygen could be used to provide an oxygen-depleted effluent.

Thus, it will be appreciated that various modifications, alternatives, variations, etc., may be made without departing from the spirit and scope of the invention as defined in the appended claims. It is, of course, intended that all such modifications are covered by the appended claims.

That which is claimed is:

1. A method for recovering methane from a solid carbonaceous subterranean formation having a production well in fluid communication with the formation and an injection well in fluid communication with the formation, the method comprising the steps of:

(a) passing a gaseous fluid containing at least 60 volume percent nitrogen and at least 15 volume percent oxygen through a membrane separator to produce an oxygen-depleted effluent;

(b) injecting the oxygen-depleted effluent into the formation through the injection well;

(c) recovering a fluid comprising methane through the production well; and (d) operating the production well so that a pressure in the production well at a wellbore location adjacent to the formation is less than an initial reservoir pressure of the formation.

2. The method of claim 1, wherein the oxygen-depleted effluent is pressurized from about 400 p.s.i.g. to about 2000 p.s.i.g.

3. The method of claim 1, wherein the oxygen-depleted effluent is pressurized to a pressure of about 500 to about 1500 p.s.i.g. above a reservoir pressure of the formation.

4. The method of claim 3, wherein the oxygen-depleted effluent has a volume ratio of nitrogen to oxygen of at least 9:1.

5. The method of claim 4, wherein the oxygen-depleted effluent contains 2 to 8% by volume oxygen.

6. The method of claim 4, wherein the gaseous fluid passed through the membrane separator comprises a mixture of gases found at the well site.

7. The method of claim 1, wherein the oxygen-depleted effluent contains 94.9% or less by volume nitrogen.

8. The method of claim 1, wherein the injection well and the production well penetrate the solid carbonaceous subterranean formation.

9. The method of claim 8, wherein the solid carbonaceous subterranean formation comprises at least one coal seam.

10. A method for recovering methane from a coalbed having a production well in fluid communication with the coalbed and an injection well in fluid communication with the coalbed, comprising the steps of:

(a) passing a gaseous fluid containing at least 60 volume percent nitrogen and at least 15 volume percent oxygen through a membrane separator to produce an oxygen-depleted effluent having less than 95% by volume nitrogen;

(b) injecting the oxygen-depleted effluent into the coalbed through the injection well; and (c) recovering a fluid comprising methane through the production well.

11. The method of claim 10, wherein the injection well and the production well penetrate the coalbed.

12. The method of claim 10, wherein the oxygen-depleted effluent is pressurized to a pressure of about 500 to about 1500 p.s.i.g. above a reservoir pressure of the coalbed.

13. The method of claim 10, wherein the oxygen-depleted effluent is pressurized to about 400 to about 2000 p.s.i.g.

14. The method of claim 10, further comprising operating the production well so that a pressure in the production well at a wellbore location adjacent to the coalbed is less than an initial reservoir pressure of the coalbed.

15. The method of claim 14, wherein the production well is operated so that the pressure in the production well adjacent the coalbed is less than 400 p.s.i.g.

16. A method of recovering methane from a coalbed penetrated by a production well producing at a pre-injection methane recovery rate, the method comprising the steps of:

(a) passing air containing about 15 to 25% by volume oxygen through a membrane separator to produce an oxygen-depleted effluent;

(b) injecting the oxygen-depleted effluent through at least one injection well spaced from the production well and at an injection rate sufficient to increase the production of methane from the production well to at least two times the pre-injection methane recovery rate within ninety days of commencing to inject oxygen-depleted effluent; and (c) operating the production well so that a pressure in the production well at a wellbore location adjacent to the coalbed is less than an initial reservoir pressure of the coalbed.

17. The method of claim 16, wherein the methane is recovered from the production well at a rate of at least two times the pre-injection methane recovery rate for at least 250 days.

18. The method of claim 16, wherein the recovery of methane from the production well is increased to at least two times the pre-injection methane recovery rate within 30 days of commencing to inject oxygen-depleted effluent.

19. The method of claim 16, wherein the recovery of methane from the production well is increased to at least five times the pre-injection methane recovery rate within sixty days of commencing to inject oxygen-depleted effluent.

20. The method of claim 19, wherein the methane is recovered from the production well at a rate of at least five times the pre-injection methane recovery rate for at least 150 days.

21. The method of claim 19, wherein the methane is recovered from the production well at a rate of at least four times the pre-injection methane recovery rate for at least 220 days.

22. A method for recovering methane from a solid carbonaceous subterranean formation having a production well in fluid communication with the formation and at least one injection well in fluid communication with the formation, the method comprising the steps of:

(a) passing a gaseous fluid containing at least 60 volume percent nitrogen and at least 15 volume percent oxygen through a membrane separator to produce an oxygen-depleted effluent;

(b) injecting the oxygen-depleted effluent into the formation through the injection well at a pressure above a formation parting pressure;

(c) recovering a fluid comprising methane through the production well; and (d) operating the production well so that a pressure in the production well at a wellbore location adjacent to the formation is less than an initial reservoir pressure of the formation.

23. The method of claim 22, wherein the solid carbonaceous subterranean formation comprises a coalbed.

24. The method of claim 23, further comprising the step of regulating the pressure, at which oxygen-depleted effluent is injected into the coalbed, so that fractures induced within the coalbed by the injection of the effluent in step b) do not extend from the injection well to the production well.

25. The method of claim 23, wherein the oxygen-depleted effluent is injected into the coalbed, so that a fracture half-length of the fractures induced within the coalbed by the injection of the effluent are less than about 30% of a spacing between an injection well and the production well.

* * * * *